United States Patent [19]

Fildan

[11] Patent Number: 4,843,689

[45] Date of Patent: Jul. 4, 1989

[54] BUCKLE FOR BANDS, BELTS AND THE LIKE

[76] Inventor: Gerhard Fildan, Dieselstrasse 20, D-7250 Leonberg, Fed. Rep. of Germany

[21] Appl. No.: 67,964

[22] Filed: Jun. 29, 1987

[51] Int. Cl.[4] ..... A44B 11/00

[52] U.S. Cl. ..... 24/200; 24/198; 24/68 E

[58] Field of Search ..... 24/200, 265 A, 169, 24/170, 176, 182, 193, 197, 198, 196

[56] References Cited

U.S. PATENT DOCUMENTS

| | | | |
|---|---|---|---|
| 2,189,574 | 2/1940 | Anderson | 24/198 |
| 3,296,673 | 1/1967 | Kirkpatrick | 24/265 |
| 4,038,726 | 8/1977 | Takabayashi | 24/169 X |
| 4,387,490 | 6/1983 | Blackburn et al. | 24/200 |
| 4,457,051 | 7/1984 | Bartolini | 24/198 |
| 4,525,901 | 7/1985 | Krauss | 24/200 |

FOREIGN PATENT DOCUMENTS

| | | | |
|---|---|---|---|
| 2917327 | 3/1984 | Fed. Rep. of Germany . | |
| 385550 | 5/1908 | France | 24/198 |
| 86457 | 9/1955 | Norway | 24/200 |

*Primary Examiner*—Kenneth J. Dorner
*Assistant Examiner*—Laurie K. Cranmer
*Attorney, Agent, or Firm*—Herbert Dubno

[57] ABSTRACT

A belt buckle of the type in which a loop can be released by lifting the buckle to permit slippage of the loop is permanently anchored to another belt portion by a bar provided with a broad contact surface connected at an inner edge by a film hinge to a flap which can press the other belt portion against this surface and an array of points are barbs which pierce this other belt portion and form a row at an outer edge of this surface which is inclined downwardly from the top of the buckle toward the outer edge.

8 Claims, 3 Drawing Sheets

BUCKLE FOR BANDS, BELTS AND THE LIKE

FIELD OF THE INVENTION

My present invention relates to a buckle for bands, belts and the like and, more particularly, to a buckle to which one end of a band or belt is substantially permanently affixed and through which another portion of the band or belt is threaded to retain the loop thus formed until the buckle is lifted.

BACKGROUND OF THE INVENTION

It is known to provide an adjustable buckle for belts, bands, strips or the like which can be adjusted along one end of the web, generally of fabric, forming the belt by passing this end of the belt in a loop through the buckle so that the loop passes around at least one bar and the two pieces of the belt which adjoin the loop are pressed against one another by another bar of the buckle to retain these pieces against slippage and thus secure the buckle with respect to the loop and hence the loop from slipping.

Edges are provided on the bars to press against the belt and thereby form the frictional retaining forces which can be relieved when the buckle is lifted.

Generally the belt end which is permanently affixed to an opposite side of the buckle is formed into a loop and stitched. This tends to increase the thickness of the assembly and precludes a generally flat configuration thereof.

Such buckles are described in U.S. Pat. No. 3,192,588 and in German Pat. No. 29 17 327 for example, and may be used to control the effective length of a belt, both of whose ends are connected by the buckle. Alternatively, the buckle may be used to connect the belt to a flexible member permanently anchored to the buckle in the manner described.

The adjustable end of the belt can be provided proximal to a handle on the buckle which can facilitate lifting of it to release the belt loop passing around a bar of the buckle.

OBJECTS OF THE INVENTION

It is the principal object of the present invention to provide an improved buckle in which the anchoring of the belt strap or web nonadjustably to the buckle can be effected in a manner which will overcome the above mentioned drawback.

Another object of this invention is to provide an improved buckle of the type described which has a generally flat configuration.

SUMMARY OF THE INVENTION

These objects and others which will become apparent hereinafter are attained, in accordance with the present invention which provides an improved method of anchoring the nonadjustable belt end to the buckle.

As noted previously, in conventional buckles, this belt end is passed through an eye which preferably can be formed by two spaced-apart bars and is looped around the outer bar, the loop being stitched closed outwardly of the buckle.

This fastening technique has the drawback that the stitched portion may have to be comparatively thick to take up the stress which may be applied to the belt. Furthermore, the stitching operation may not always be convenient.

According to the invention, this problem is eliminated by providing a buckle which comprises a generally rectangular one-piece frame with a pair of side walls bridged by bars formed unitarily with the side walls, e.g. by an injection molding operation and having at least one bar around which the adjustable belt portion can pass and a further bar pressing the loop thus formed closed until the buckle is lifted.

According to this invention, the buckle body is provided at an end of the frame opposite that provided with these bars with a fastening bar forming a relatively broad engagement surface onto which another belt portion may be laid. According to the invention, moreover, on an inner edge of this contact surface, a cover flap is swingably mounted by a film hinge and the contact surface preferably is inclined away from the top of the buckle in the direction of this latter end, i.e. the direction in which this portion of the belt is inserted into the buckle. Proximal to the outer edge of this surface, a multiplicity of points or barbs can be formed, the points or barbs being adapted to pierce the belt portion which is to be laid on the contact surface.

When the flap is closed against the points and preferably sealed in its closed position, e.g. by ultrasonic welding or heat sealing, the anchored portion of the belt is permanently retained and an extremely flat configuration can be achieved.

Preferably the inclination of the contact surface is 10° to 20°.

The buckle, therefore, contains within itself the means for permanently anchoring the belt end to the buckle so that stitching of a loop is not required.

In general, the tension on the belt will hold the pressing bar on the opposite end of the buckle against the two pieces of belt which are connected by the bight which passes around the cooperating bar for the adjustable belt end.

A grip may extend the buckle beyond the pressing bar so that when this grip is lifted, the engagement of the loop can be released or loosened and slippage of the loop permitted.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
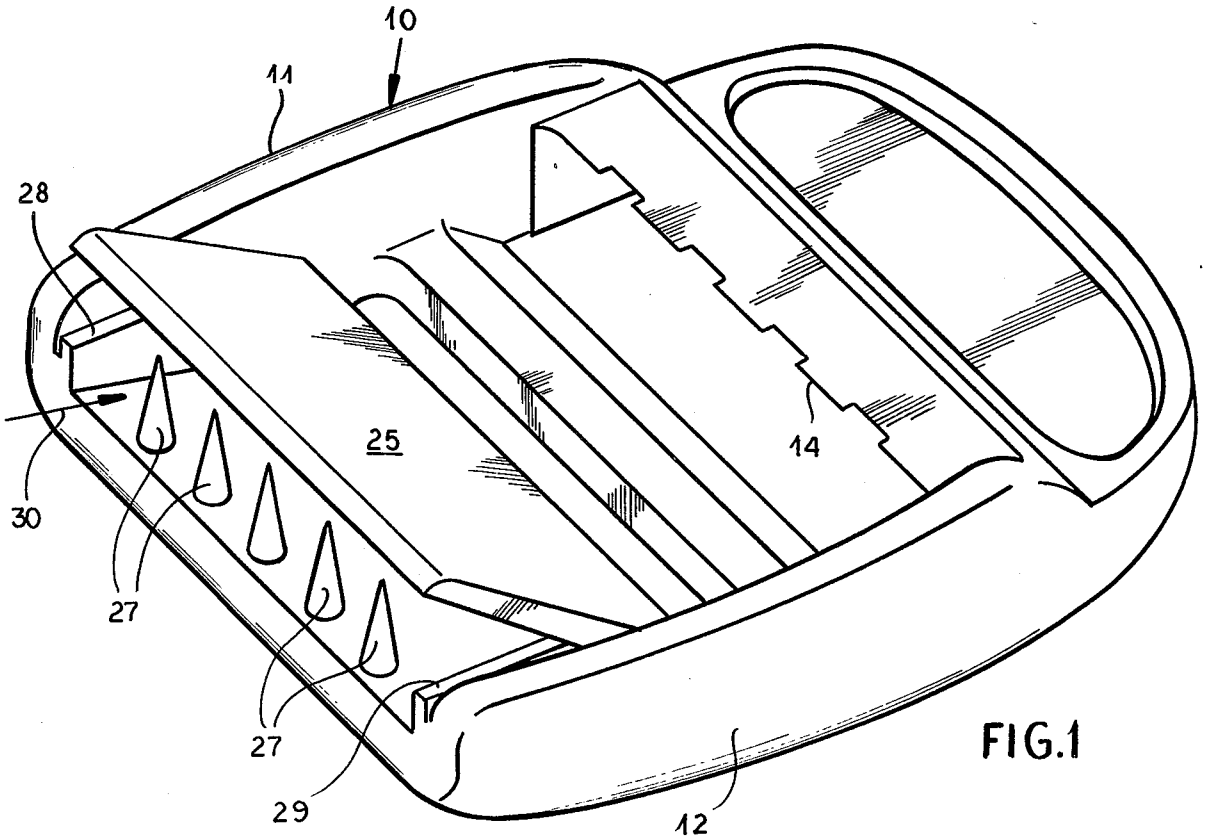
FIG. 1 is a perspective view of the buckle seen from its underside.
Figure 2:
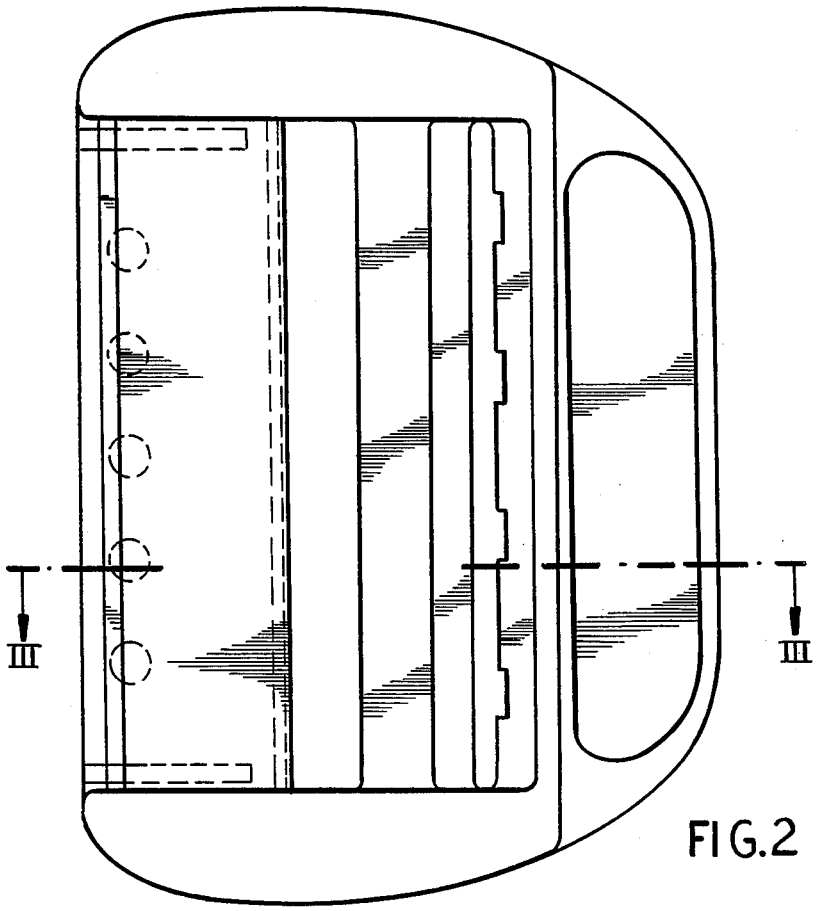
FIG. 2 is a bottom view of the buckle.
Figure 3:
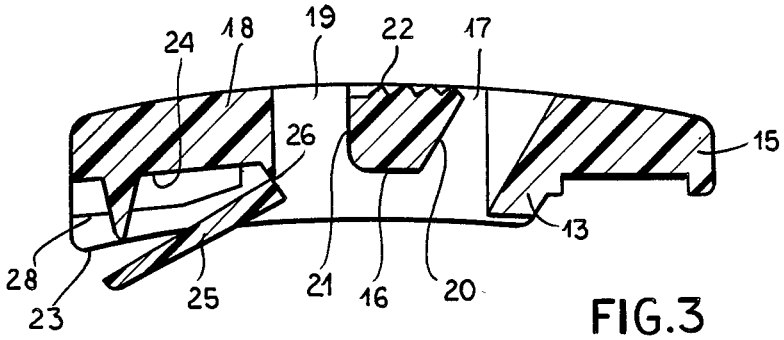
FIG. 3 is a cross sectional view taken along the line III—III of FIG. 2.

Referring first to FIGS. 1–3, it can be seen that the buckle of the invention comprises a body 10 which may abe molded in one piece from a synthetic resin. According to the invention, this buckle comprises a pair of side members 11 and 12 which are bridged by a number of bars including a pressing bar 13 which can be provided with a toothed lower edge 14 and from which a handle 15 can project to extend the buckle.

An intermediate bar 16 also bridges the two side walls 11 and 12 and defines with the pressing bar 13, a window or passage 17.

A further bar 18 at the other end of the buckle also bridges the side members and defines a window or passage 19 with the intermediate bar 16.

The latter has downwardly converging flanks 20 and 21 to guide the belt portions, as will be described, and a ribbed or toothed upper portion 22 to promote frictional engagement with the belt portions.

The bar 18 is formed, at a location recessed above the bottommost edges 23 of the side members 11 and 12, with a contact surface 24 which is comparatively broad, i.e. has a width which is sufficient to enable an ample length of a belt portion to be permanently anchored to the ledge thereon.

At an inner edge of this surface 24, a bar 18 is connected to a pivot flap 25 by a film hinge 26 constituting a thin film of the synthetic resin material form which the buckle is molded. At the opposite end of the surface 24 a row of points 27 is provided, the points also being molded unitarily with the bar 18 and hence the rest of the one-piece buckle.

A pair of ledges 28 and 29 are provided to flank the recess 30 formed between the flap 25 and the surface 24 in which the anchored belt portion will be ensconced.

Figure 4:
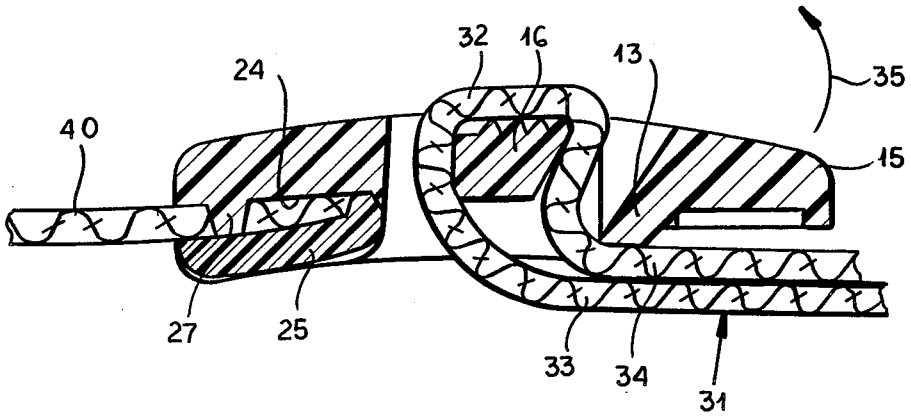
FIG. 4 is a view of the buckle of FIG. 3 in its closed position engaging two belt portions, one permanently and the other adjustably.

Turning now to FIG. 4, it can be seen that in use, an adjustable belt end 31 is threaded through the passages 19 and 17 so that a loop 32 of this belt end is formed around the bar 16 while the bar 13 presses the two passes 33 and 34 adjoining this loop or the bight formed thereby against one another to prevent slippage of the loop. When the handle 15 is lifted, e.g. as represented by the arrow 35, however, the pressure on the pieces 33 and 34 of the belt portion defining the loop 32 is relieved and adjustment of the loop with respect to the buckle is possible.

Another belt portion 40 of the same or another belt or piece of material is placed upon the surface 24 and pierced by the pins 27. The flap 25 is then forced against the points and is heat-sealed to them and to the ledges 28 and 29, thereby flattening the points or causing them to pierce the flap as may be desired, but permanently ensconcing the end of the belt portion 40 in the chamber 30 previously described.

The surface 24 is inclined downwardly away form the top of the belt at an angle of 10° to 20°, thereby ensuring that the belt will lie close to any surface against which the bottom of the buckle rests to minimize any gap with respect to that surface.

I claim:

1. A buckle for connecting two belt portions, comprising a unitary substantially rectangular frame body formed with a pair of side members, a pair of bars bridging said side members and adapted to receive a loop of an adjustable belt portion for retaining said loop against slippage until the buckle is lifted, and a further bar bridging said side members, said further bar being formed with a broad contact surface against which another belt portion to be anchored to said body can lie, a flap juxtaposed with said surface and connected by a film hinge to the bar forming said surface along an inner edge of said surface and adapted to retain said other portion against said surface, said film hinge being parallel to said bars, and a row of points projecting from said surface proximal to an outer edge thereof for piercing said other belt portion, said points lying in a row transverse to a direction in which said other belt portion is subjected to tension and being spaced apart parallel to said edge, said surface being inclined downwardly away from a top of said buckle toward said outer edge, said flap being juxtaposed with and overhanging said row of points, said surface is downwardly inclined at an angle of substantially 10° to 20°, said flap and said surface defining a compartment opening outwardly from said body and receiving said other portion, said compartment being laterally delimited by a pair of ledges against which said flap is pressed.

2. The buckle defined in claim 1 wherein said body is formed with a handle to facilitate lifting of the buckle and projecting in a direction away from said outer edge.

3. A buckle for connecting two belt portions, comprising a unitary substantially rectangular frame body formed with a pair of side members, a pair of bars bridging said side members and adapted to receive a loop of an adjustable belt portion for retaining said loop against slippage until the buckle is lifted, and a further bar bridging said side members, said further bar being formed with a broad contact surface against which another belt portion to be anchored to said body can lie, a flap juxtaposed with said surface and connected by a film hinge to the bar forming said surface along an inner edge of said surface and adapted to retain said other portion against said surface, said film hinge being parallel to said bars, and a row of points projecting from said surface proximal to an outer edge thereof for piercing said other belt portion, said points lying in a row transverse to a direction in which said other belt portion is subjected to tension and being spaced apart parallel to said edge, said surface being inclined downwardly away from a top of said buckle toward said outer edge, said flap being juxtaposed with and overhanging said row of points, said flap and said surface defining a compartment opening outwardly from said body and receiving said other portion, said compartment being laterally delimited by a pair of ledges against which said flap is pressed.

4. A buckle and belt assembly, comprising an adjustable belt portion; another belt portion; and a buckle, said buckle comprising a unitary substantially rectangular frame body formed with a pair of side members, a pair of bars bridging said side members and adapted to receive a loop of said adjustable belt portion for retaining said loop against slippage until the buckle is lifted, and a further bar bridging said side members, said further bar being formed with a broad contact surface against which said other belt portion can lie, a flap juxtaposed with said surface and connected by a film hinge to the bar forming said surface along an inner edge of said surface and adapted to retain said other portion against said surface, said film hinge being parallel to said bars, and a row of points parallel to said film hinge projecting from said surface proximal to an outer edge thereof for piercing said other belt portion, said points lying in a row transverse to a direction in which said other belt portion is subjected to tension, said surface being inclined downwardly away from a top of said buckle toward said outer edge, said flap being juxtaposed with and overhanging said row of points, said flap and said surface defining a compartment opening outwardly from said body and which receives said other portion, said compartment being laterally delimited by a pair of ledges against which said flap is pressed.

5. The buckle and belt assembly defined in claim 4 wherein said surface is downwardly inclined at an angle of substantially 10° to 20°.

6. The buckle and belt assembly defined in claim 4 wherein said bar around which said loop passes has a toothed surface.

7. The buckle and belt assembly defined in claim 4 wherein said body is formed with a handle to facilitate lifting of the buckle and projecting in a direction away from said outer edge.

8. A buckle and belt assembly, comprising an adjustable belt portion; another belt portion; and a buckle, said buckle comprising a unitary substantially rectangular frame body formed with a pair of side members, a pair of bars bridging said side members and adapted to receive a loop of said adjustable belt portion for retaining said loop against slippage until the buckle is lifted, and a further bar bridging said side members, said further bar being formed with a broad contact surface against which said other belt portion can lie, a flap juxtaposed with said surface and connected by a film hinge to the bar forming said surface along an inner edge of said surface and adapted to retain said other portion against said surface, said film hinge being parallel to said bars, and a row of points projecting from said surface proximal to an outer edge thereof for piercing said other belt portion, said points lying in a row transverse to a direction in which said other belt portion is subjected to tension, said surface being inclined downwardly away from a top of said belt toward said outer edge, said flap being juxtaposed with and overhanging said row of points, said flap and said surface defining a compartment opening outwardly from said body and which receives said other portion, said compartment is laterally delimited by a pair of ledges against which said flap is pressed, said flap being welded to said ledges after said other portion has been received in said other compartment and said points have been flattened.

* * * * *